US008506203B2

(12) United States Patent
Spencer et al.

(10) Patent No.: US 8,506,203 B2
(45) Date of Patent: Aug. 13, 2013

(54) TIRE DEFLATION DEVICE

(75) Inventors: Ethan Spencer, Finksburg, MD (US); Eric Spencer, Finksburg, MD (US); Stacey Spencer, Finksburg, MD (US)

(73) Assignee: Dynasystems, LLC, Finksburg, MD (US)

( * ) Notice: Subject to any disclaimer, the term of this patent is extended or adjusted under 35 U.S.C. 154(b) by 0 days.

(21) Appl. No.: 13/405,252

(22) Filed: Feb. 25, 2012

(65) Prior Publication Data

US 2012/0243935 A1 Sep. 27, 2012

Related U.S. Application Data

(60) Provisional application No. 61/465,662, filed on Mar. 23, 2011.

(51) Int. Cl.
*E01F 13/12* (2006.01)

(52) U.S. Cl.
USPC ..... 404/6

(58) Field of Classification Search
CPC ..... E01F 13/12
USPC ..... 404/6, 9
See application file for complete search history.

(56) References Cited

U.S. PATENT DOCUMENTS

| | | | | |
|---|---|---|---|---|
| 4,995,756 | A | 2/1991 | Kilgrow et al. | |
| 5,330,285 | A | 7/1994 | Greves et al. | |
| 5,498,102 | A | 3/1996 | Bissell | |
| 5,507,588 | A | 4/1996 | Marts et al. | |
| 5,871,300 | A | 2/1999 | Ingham | |
| 6,048,128 | A | 4/2000 | Jones, III et al. | |
| 6,155,745 | A | 12/2000 | Groen et al. | |
| 6,527,475 | B1 | 3/2003 | Lowrie | |
| 6,623,205 | B1 | 9/2003 | Ramirez | |
| 6,758,628 | B1 | 7/2004 | Curry, Jr. | |
| 7,056,054 | B1 | 6/2006 | Keith et al. | |
| 7,641,417 | B2 | 1/2010 | Barker | |
| 7,850,392 | B2 | 12/2010 | Schubert | |
| 7,997,825 | B2 | 8/2011 | Martinez et al. | |
| 2008/0124171 | A1 | 5/2008 | Moormeier et al. | |
| 2011/0033233 | A1* | 2/2011 | D'Almeida | 404/6 |
| 2011/0097147 | A1* | 4/2011 | Castro et al. | 404/6 |
| 2011/0135385 | A1* | 6/2011 | Washington | 404/6 |

* cited by examiner

*Primary Examiner* — Raymond W Addie

(57) ABSTRACT

A tire deflation device capable of being remotely operated to extend and retract a spike assembly into the path of a vehicle to controllably deflate one or more of its tires is described. An embodiment includes a self contained supply of pressurized air that is in communication with an actuator that operatively extends and retracts the spike assembly based on a signal received from a wireless remote control.

18 Claims, 5 Drawing Sheets

TIRE DEFLATION DEVICE

This application claims the benefit of U.S. Provisional Application Ser. No. 61/465,662 filed on Mar. 23, 2011.

BACKGROUND OF THE INVENTION

This invention relates generally to tire deflation devices and more particularly to tire deflation devices that allow the tire deflation device to be operated from a safe location using a remote control.

SUMMARY OF THE INVENTION

It is well recognized that police officials from time to time find it necessary to stop a vehicle being operated by persons who are fleeing or attempting to avoid being stopped.

Portable barricades have often been used in attempts to stop a vehicle. The blockade may be framed structures but often a portable barricade is formed with police vehicles placed to extend transversely across a roadway. It is not uncommon, however, that fugitives will attempt to drive through a blockade of saw-horse type or other framed structures or around or even through a blockade of vehicles. Naturally, there is a potentially high element of danger to police officers manning a road block and the cost is very high should a fugitive attempt to crash his vehicle through a barricade, particularly if the barricade is made of police vehicles.

Generally, also, it requires a large number of police personnel to set up and man a road blockade.

The need for a means of disabling a vehicle that can be established and manned by even a single police officer and that will effectively disable a vehicle containing one or more fleeing individuals has been recognized in the past. Thus, for example, in U.S. Pat. No. 4,995,756 to Kilgrow et al., (incorporated herein in its entirety by reference) there is disclosed a vehicle disabling means in the form of a plurality of hollow, spike-like devices adapted to extend perpendicular to a road surface to puncture one or more tires of a fleeing vehicle. The device may be folded up and stored in the trunk of a police cruiser. In order to be deployed however, a police officer must wait by the side of the road for the fleeing vehicle to approach, and then manually throw the device into the path of the fleeing vehicle. Once the fleeing vehicle drives over the extend device, the officer then retrieves the device from the road surface by pulling a rope attached to the device to prevent damage to police cars that are in pursuit of the fleeing vehicle.

Other tire puncturing devices, using hollow needles arranged to point vertically upwardly or upwardly at an angle and supported by metal bars or heavy canvas and/or rubber mats have also been known.

Since the introduction of these manual type devices, the most popular to date being marketed as the "Stinger" and the "Stop Stick", there have been dozens of police officers killed while deploying this type of tire deflation device. It has been found that in some cases, the fleeing vehicle will attempt to avoid the spikes by driving around the device and strike the police officer that is standing on the side of the road. This issue has caused some police departments to stop using this type of tire deflation devices altogether.

There therefore is a need for a tire deflation device that can be easily extended and retracted by a police officer from a safe location away from the placement of the device. The device must be lightweight so that it can be placed along the road easily by a single person and it must be compact so that it may be stored in the trunk of a police cruiser.

OBJECTS OF THE INVENTION

In addition, other objects of the invention are to provide a remotely controlled tire puncturing device that is compactly folded and stored; that can be immediately used without prior assembly; that can be used to disable a vehicle regardless of the direction of travel of the vehicle; and that can be made of lightweight materials that will leave hollow spikes in tires passed thereover and that will leave the base support for the spikes undamaged and ready for re-use.

DETAILED DESCRIPTION

Figure 1:
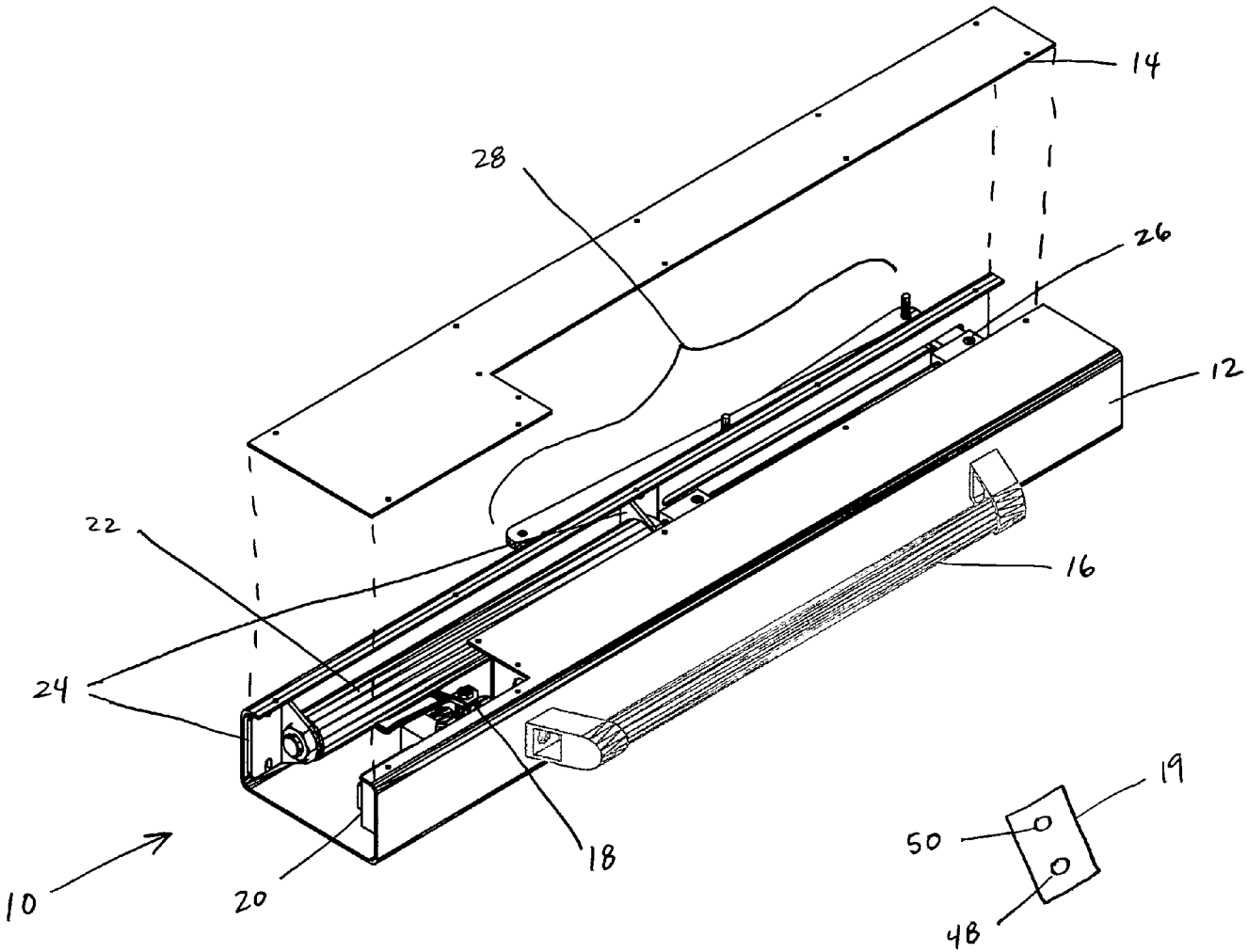
FIG. 1 is a simplified exploded isometric view in accordance with an embodiment of the invention.
Figure 2:
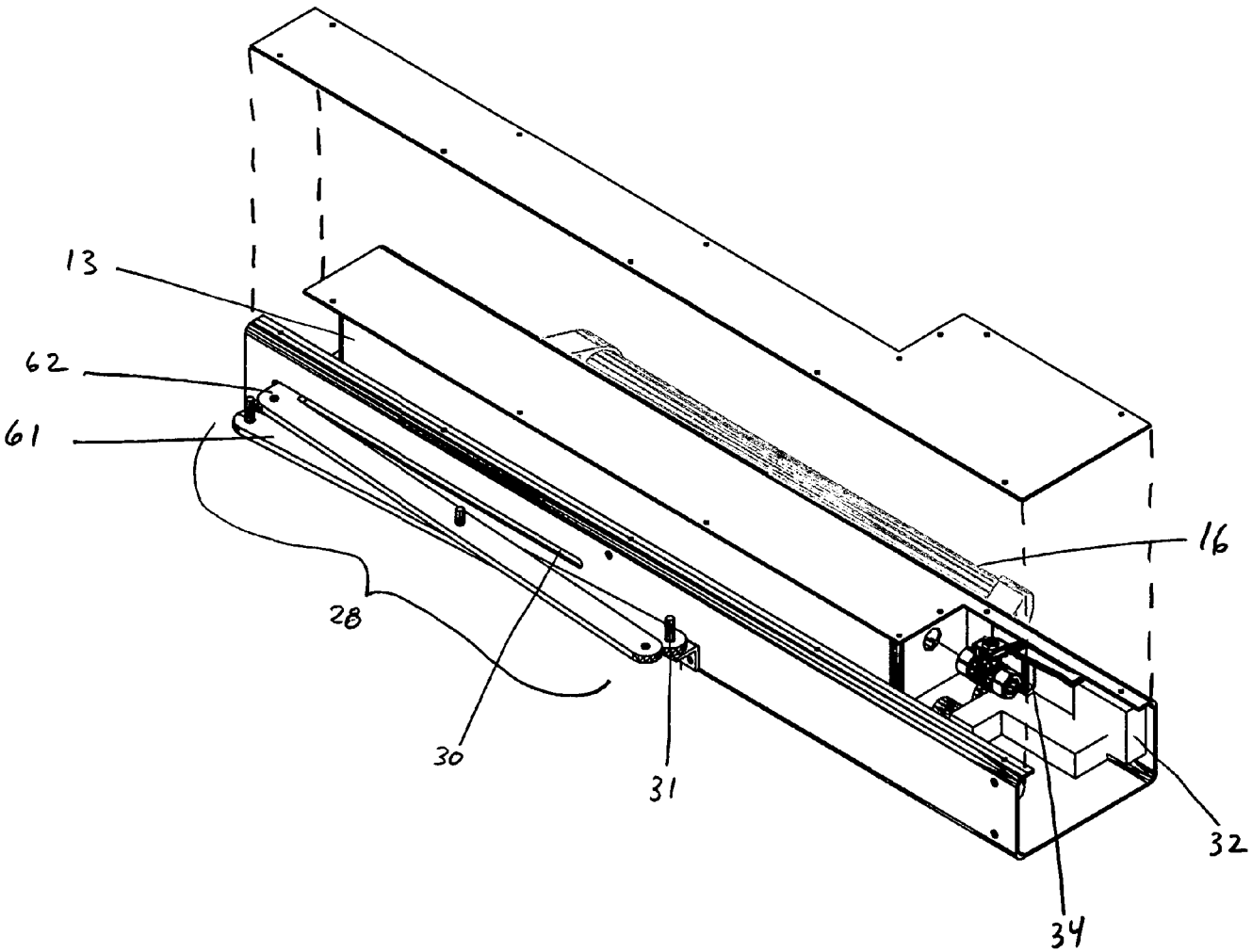
FIG. 2 is a simplified exploded isometric view in accordance with an embodiment of the invention.
Figure 3:
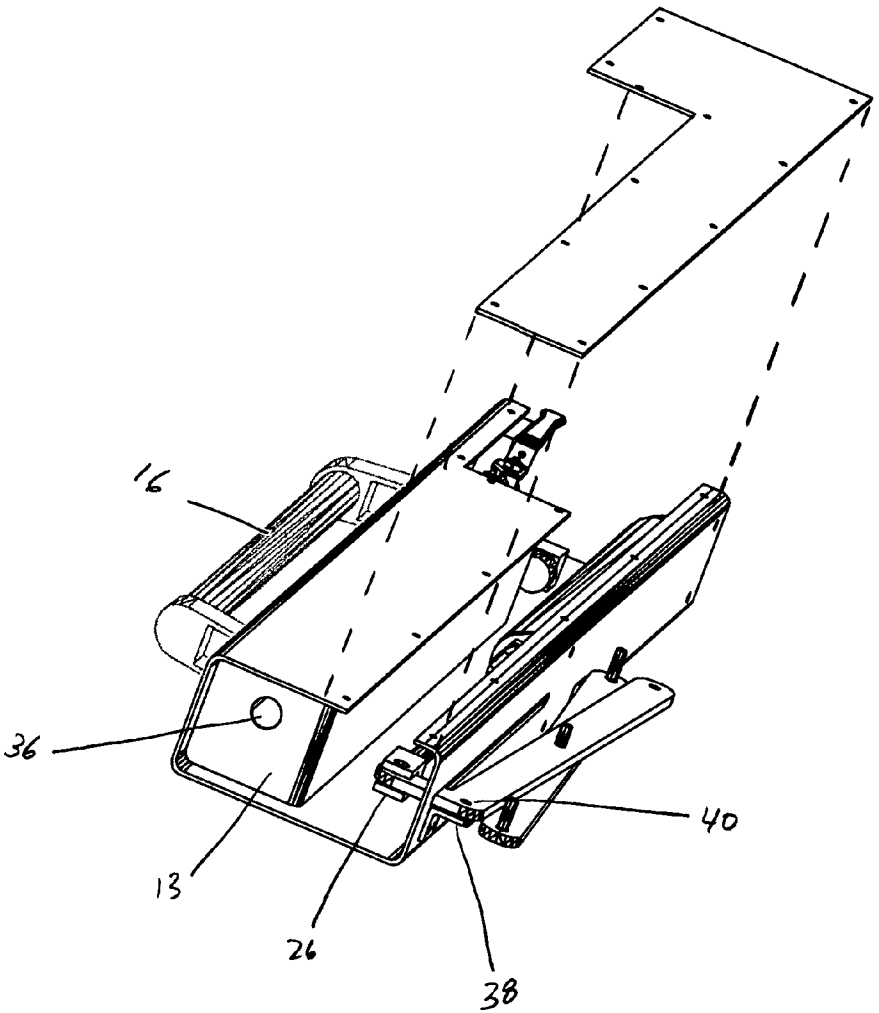
FIG. 3 is a simplified exploded isometric view in accordance with an embodiment of the invention.

Referring first to FIGS. 1 to 4, which depicts various isometric views of an embodiment of the tire deflation device 10 which comprises a main housing 12 that is sized and configured to house the majority of the components of the device 10. A top cover 14 is removably attached to the main housing 12 such that it allows for easy access to the various components contained in the device 10. A reservoir 13 is provided integral to the main housing 12 which allows for the storage of a pressurized fluid/gas within the device 10. In this embodiment, the reservoir 13 is configured to hold a pressurized fluid or gas such as, for example, pressurized air. In the embodiment shown, the reservoir 13 is fabricated from a single piece of bent aluminum plate that is welded into the main housing 12, thereby providing a lightweight but structurally rigid volume in which to store the pressurized fluid/gas. The reservoir 13 may be designed to contain up to 140 psi of pressurized air.

A shutoff valve 18 affixed to a wall of the reservoir 13 may be optionally provided to selectively open and close the flow of pressurized fluid/gas from the reservoir 13. In the embodiment shown, the handle to the shutoff valve 18 may extend through the top cover 14 so that it may be easily operated by the user. An inlet valve 36 also affixed to a wall of the reservoir may be provided to allow for the transfer of a pressurized fluid/gas into the reservoir 13. In the embodiment shown, the inlet valve 36 is a shrader type air inlet valve that is configured to interface with a standard air compressor.

A handle 16 may be affixed to the main housing 12 to facilitate the lifting, carrying and placement of the device 10 by a single person. In the embodiment shown, the handle extends along the back side of the main housing 12 and is appropriately sized so that the device 10 may be carried in one hand.

Affixed by a pair of actuator brackets 24 to an inside wall of the main housing 12 is an actuator 22. In the embodiment shown, the actuator 22 is a double acting piston that is configured to extend and retract along the longitudinal axis of the main housing 12. Further, in the embodiment shown, the actuator 22 is a pneumatic piston with a total stroke of around 12 inches.

Disposed in the main housing 12 may be a receiver 34 that is configured to communicate with a remote control 19. The receiver 34 may be powered by an onboard battery pack 32. In the embodiment shown, the battery pack 32 is comprised of 8 AA batteries that provide 12 volts DC to the receiver 34. While the embodiment shown depicts the use of a wireless remote control system, it would be very easy for someone skilled in the art to replace the wireless remote control with a wired or direct connection type control. The present invention contemplates all such modifications. The receiver 34 is essentially a remote controlled electrical switch that is connected between the battery pack 32 and an electronic control valve 20. The electronic control valve 20 is powered by the battery pack 32 and configured to selectively direct the flow of the pressurized fluid/gas from the reservoir 13 to the actuator 22. In the embodiment shown, the control valve 20 is configured to direct the flow of the pressurized fluid/gas such that the actuator 22 is maintained in an extended position when no power is provided to the control valve 20. Again, in the embodiment shown, when power is applied to the control valve 20, the pressurized fluid/gas is directed to the actuator 22 to retract the actuator. With this arrangement, the remote control 19 is in communication with the receiver 34, the receiver 34 selectively controls the control valve 20 which in turn extends and retracts the actuator 22 using the pressurized fluid/gas in the reservoir 13. In the embodiment shown, the control valve may be a 4-way, 2 position solenoid valve that operates on 12 VDC voltage.

Pivotally attached to a distal end of the actuator 22 at a link attachment point 26 is a first link 62 of a spike assembly 28 that extends through a slot 30 disposed on a wall of the main housing 12. The configuration of the spike assembly 28 is comprised of a plurality of interconnected and pivoting upper links 58 and lower links 61. The spike assembly 28 is well known in the art and is configured to pivotally extend and retract using a scissor like motion. The advantage of this type of spike assembly arrangement is when retracted it takes up very little space, but it can be extended over quite a distance when pivoted to an extend configuration. This type of spike assembly 28 is described in more detail in U.S. Pat. Nos. 4,995,756 and 7,850,392, the disclosures of which are incorporated herein by reference.

Figure 4:
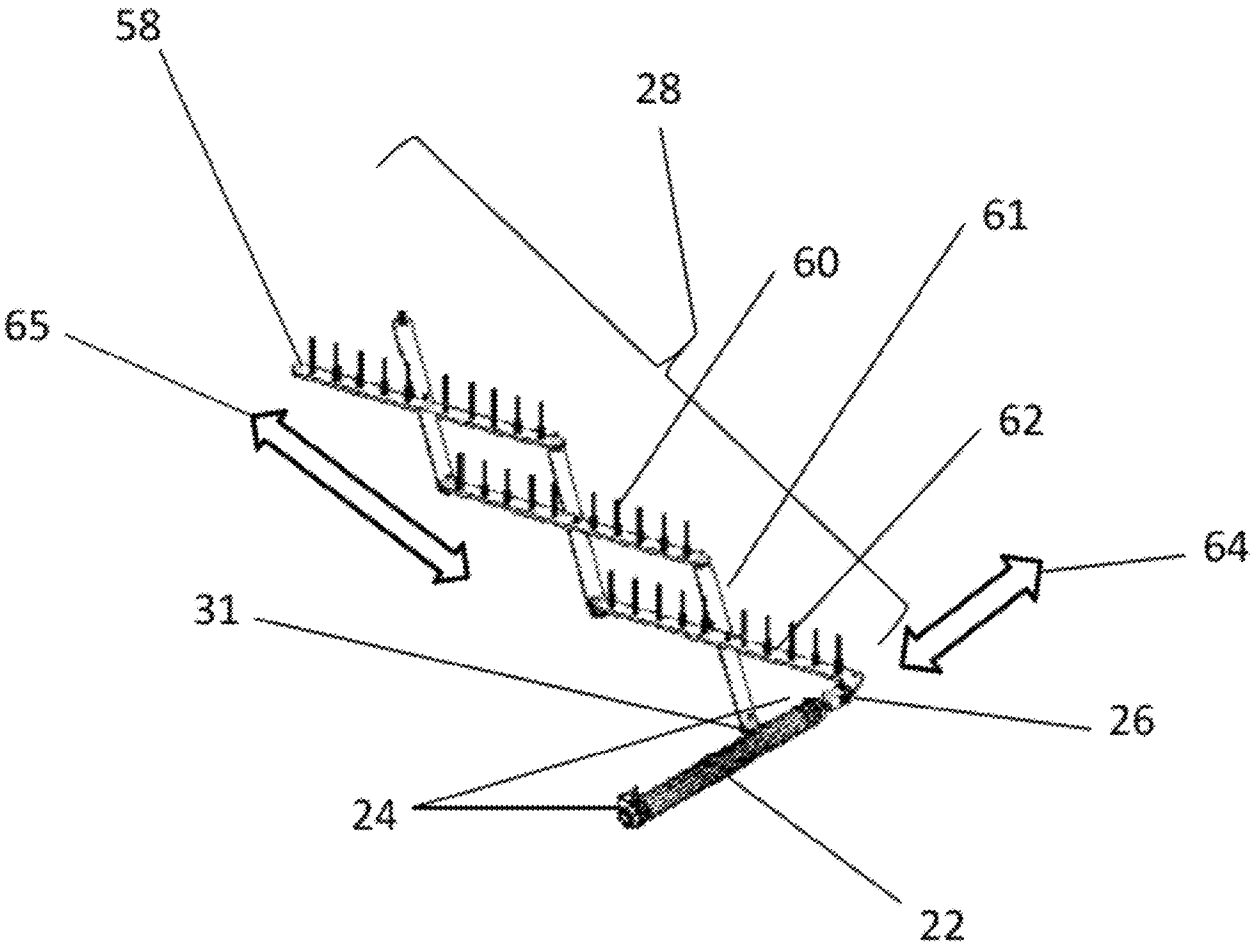
FIG. 4 is a partial isometric view of a spike assembly and actuator in accordance with an embodiment of the invention.

As more clearly shown in FIG. 4, a plurality of spikes 60 may be removably disposed along the longitudinal axis of each upper link 58 such that when the spike assembly 28 is extended across a road, the spikes 60 are able to penetrate the tire(s) of a fleeing vehicle. The spikes 60 are configured to penetrate into an automobile tire and may release from the upper link 58 and remain in the tire. The spikes 60 may be hollow to create a controlled leakage path of air from the fleeing vehicle's tire which may result in a controlled stop of the fleeing vehicle.

The spike assembly 28 is operatively extended and retracted by the actuation of the actuator 22. A fixed pivot 31 is disposed on an outside wall of the main housing 12 adjacent the slot 30. The first link 62, as mentioned previously, is pivotally connected to the actuator 22 at the link attachment point 26 such that when the actuator 22 is retracted, as shown by the arrow 64, the spike assembly 28 pivots to an extended position as shown by arrow 65. When the actuator 22 is extended as shown by arrow 64, the spike assembly 28 will fold up to a retracted position as shown by arrow 65. With this arrangement, the spike assembly 28 may be quickly and controllably extended and retracted into the path of a fleeing vehicle by extending and retracting the actuator 22.

It should be mentioned that the exact configuration of the actuator 22 to the spike assembly 28 may take on many variations. For example, the extension and retraction of the actuator 22 could be reversed such that when the actuator 22 extends, so does the spike assembly 28 and vice versa. Another variation is the attachment point of the actuator 22 to the spike assembly 28 could be easily reconfigured to result in the same or similar operation. For example, the link attachment point 26 could be arranged such that the actuator 22 is pivotably connected to the center pivot point of the first pair of links. With this configuration the actuator 22 would not operate along the longitudinal axis of the main housing 12, but would be approximately perpendicular to the main housing 12. All such variations are fully contemplated by the invention.

In order to provide additional safety and to prevent inadvertent operation of the device 10, an optional lock bracket 38 may be affixed to the main housing 12 adjacent the slot 30 and a removable lock pin 40 may be inserted through a hole in the first link 62 into a hole in the lock bracket 38 such that when the pin 40 is inserted, the spike assembly 28 cannot extend.

Figure 5:
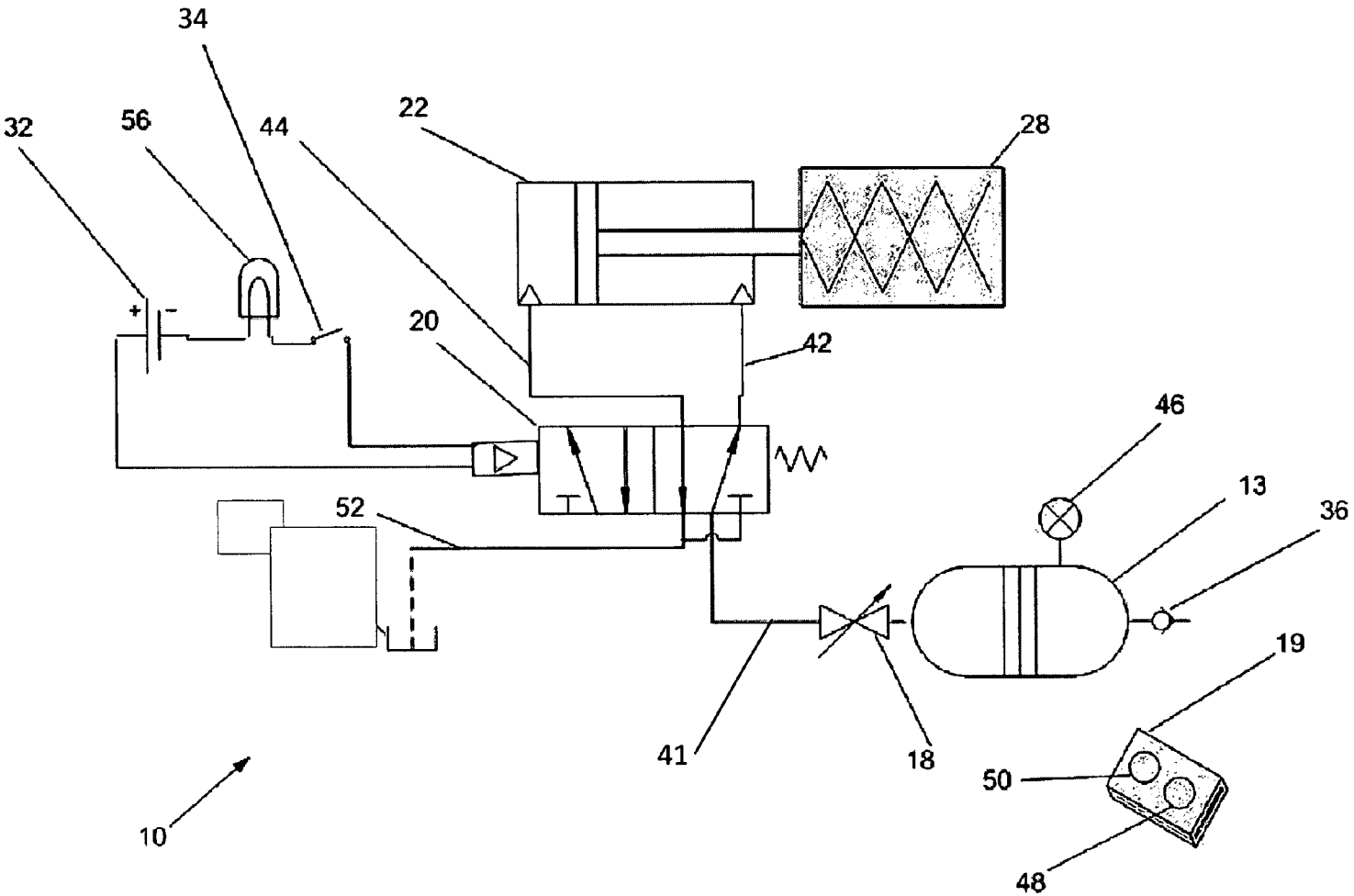
FIG. 5 is a simplified schematic diagram in accordance with an embodiment of the invention.

Referring now to FIG. 5, (where like numerals apply to like features) which depicts a simplified schematic in accordance with an embodiment of a tire deflation device 10. A pressure gauge 46 may be provided which is configured to indicate the pressure of the fluid/gas contained in the reservoir 13. As discussed previously, an inlet valve 36 is disposed on the reservoir 13 for the transfer of a pressurized fluid into the reservoir 13. A manually operated shutoff valve 18 is similarly disposed on the reservoir 13 which opens and closes the flow of fluid/gas out of the reservoir 13.

A pressure line 41 is in fluid communication with an inlet port of the control valve 20 such that when the control valve 20 is unpowered, the pressurized fluid is communicated to the actuator 22 via a first conduit 42 to keep the spike assembly 28, for safety reasons, in a retracted position The control valve 20 may be a two position solenoid valve, where the first unpowered position directs the flow of the pressurized fluid through the first conduit 42 to maintain the spike assembly 28 in the retracted position and the second position directs the flow of the pressurized fluid through a second conduit 44 to operatively move the spike assembly 28 to an extended position. The control valve 20 is electrically connected to the battery pack 32 and the receiver 34, which operatively controls which position the control valve 20 is in.

For example, the remote control 19 may have two push buttons disposed on the remote. An extend button 50 would send a signal to the receiver 34 to apply power to the control valve 20 which would place the control valve 20 in the second position and this would direct the flow of the pressurized fluid/gas to extend the spike assembly 28. A retract button 48 on the remote control 19, when selected, may send a signal to the receiver 34 which may remove power from the control valve 20 and the control valve 20 will return to the first position and this will direct the flow of pressurized fluid/gas to retract the spike assembly 28.

With this arrangement, the remote control 19, in the hands of a police officer located some distance away from the spike assembly, in a safe location, away from the path of the fleeing vehicle, can extend and retract the spike assembly 28.

An exhaust line 52 may be provided in communication with the control valve 20 to allow the actuator 22 to vent in either direction and therefore let the actuator 22 extend and retract as required. A power indicator lamp 56 may also be provided to indicate to the user when the battery 32 is in communication with the control valve 20.

Now the operation and use of the tire deflation device 10 shall be described in more detail. With reference to FIGS. 1 to 4 again, the tire deflation device 10 will typically be stored in the trunk of a police cruiser. The reservoir 13 typically would be prefilled with compressed air using a standard compressor connected to the fill valve 36 to a pressure not greater than 140 psi and not less than 50-60 psi as indicated on the pressure gauge 46.

To place the tire deflation device 10 into the path of a fleeing vehicle, a police officer would remove the device 10 from the trunk using the handle 16. While not shown for clarity, a cover may be provided over the spike assembly 28 to prevent injury from the sharp tips of the spikes 60. This cover would be removed and the device 10 would be placed along the shoulder of a road where the fleeing vehicle is expected to cross.

To ready the device 10 for deployment, first the user would remove the lock pin 40 from the first link 62. Next, the user would open the shutoff valve 18 and turn on the power to the device. The device 10 is now ready to control the extension and retraction of the spike assembly 28 across the road and into the path of the fleeing vehicle.

The user can now move to a safe location away from the area of the device 10. As the fleeing car approaches the area adjacent the device 10, the user would depress the extend button 50 on the remote control 19 which will cause the spike assembly 28 to fold open and extend across the road into the path of the fleeing vehicle.

The fleeing vehicle will drive over the spike assembly 28 and one or more of the spikes 60 will penetrate one or more tires and remain in the tire as it continues over the spike assembly 28. The hollow spike 60 will cause the air to leak from the tire of the fleeing vehicle. Once the fleeing vehicle has completely cleared the area of the spike assembly 28, the user may push the retract button 48 located on the remote 19, and the spike assembly 28 will fold up into a retracted position and allow cars that are pursuing the fleeing vehicle to continue the chase without being damaged by the device 10.

The user may now retrieve the device 10 from the side of the road by first reinserting the lock pin 40, turning off the power and placing the shut off valve 18 to a closed position. The user may then replace any missing spikes 60 and using the inlet valve 36 recharge the reservoir 13 using a standard air compressor. The unit is now ready to be stored in a police cruiser's trunk, ready for the next pursuit.

Although an exemplary embodiment of the invention has been shown and described, many changes, modifications, and substitutions may be made by one having ordinary skill in the art without necessarily departing from the spirit and scope of this invention. For example, in the embodiment described, pressurized air may be the working fluid, however, the particular type of fluid used is not important and may be easily changed. This is just one example of the type of modifications that are fully contemplated by the invention disclosed herein.

What is claimed is:

1. A tire deflation device comprising a spike assembly having an extended and retracted position, said spike assembly having a scissor like motion between its extended and retracted position, a plurality of spikes affixed to and protruding from said spike assembly, said spikes being configured to penetrate a car tire and cause the car tire to deflate, a single actuator having an extended and retracted position, said actuator operatively connected to said spike assembly configured to selectively move said spike assembly in a scissor like motion to said extended and retracted position, and a supply of fluid in communication with said actuator, said supply of fluid configured to selectively move said actuator to said extended and retracted position.

2. The tire deflation device of claim 1 further comprising a remote control configured to select the position of said spike assembly.

3. The tire deflation device of claim 2, wherein said remote control is wireless.

4. The tire deflation device of claim 1, wherein said fluid is pressurized air.

5. The tire deflation device of claim 4, wherein said pressurized air is stored in a reservoir disposed on said tire deflation device.

6. The tire deflation device of claim 5, wherein said pressurized air may be recharged to a specified pressure.

7. The tire deflation device of claim 1, wherein said plurality of spikes are hollow and are configured to release from said spike assembly and remain in the car tire.

8. The tire deflation device of claim 1, further comprising a removable lock pin configured to prevent the movement of said spike assembly to said extended position.

9. The tire deflation device of claim 1, further comprising an electronically powered control valve in fluid communication with said supply of fluid, said control valve configured to direct the flow of said fluid to said actuator to operatively select the position of said actuator.

10. A tire deflation device configured to deflate a car tire comprising a scissor-like spike assembly operatively connected to a single actuator wherein said actuator moves said spike assembly in a scissor like motion between an extended and retracted position.

11. The tire deflation device of claim 10 further comprising a remote control in communication with said tire deflation device configured to control the movement of said spike assembly.

12. The tire deflation of claim 11 wherein said remote control is in wireless communication with said tire deflation device.

13. The tire deflation device of claim 10 further comprising a plurality of spikes affixed to said spike assembly, said spike being configured to penetrate a pneumatic tire.

14. The tire deflation device of claim 10 further comprising a reservoir of pressurized fluid in fluid communication with a control valve, said control valve configured to control the position of said actuator.

15. The tire deflation device of claim 14, further comprising a remote control in communication with said control valve.

16. The tire deflation device of claim 15, wherein said remote control is in wireless communication with a receiver disposed in said tire deflation device.

17. A method for disabling an automobile by deflating one or more tires including the steps of:

placing a tire deflation device adjacent the path of a moving vehicle with a spike assembly in a retracted position;

providing a supply of pressurized fluid;

providing a single actuator operatively affixed to said spike assembly, said actuator being in fluid communication with said pressurized fluid and said actuator further being configured to extend and retract said spike assembly;

providing a valve in fluid communication between said supply of pressurized fluid and said actuator, said valve being in communication with a remote control;

extending said spike assembly into the path of the moving vehicle in response to a signal from said remote control;

puncturing at least one tire with a spike and deflating the tire; and, retracting said spike assembly into said retracted position in response to a signal from said remote control.

18. The method of claim 17, wherein said remote control is in wireless communication with said tire deflation device.

* * * * *